US005607261A

United States Patent [19]

Odom et al.

[11] Patent Number: 5,607,261

[45] Date of Patent: Mar. 4, 1997

[54] CLAMSHELL POWER INSTALLED SCREW ANCHOR

[75] Inventors: James T. Odom; Robert M. Hoyt; Daniel V. Hamilton, all of Centralia, Mo.

[73] Assignee: Hubbell Incorporated, Orange, Conn.

[21] Appl. No.: 564,730

[22] Filed: Nov. 29, 1995

[51] Int. Cl.[6] ..... E02D 5/80

[52] U.S. Cl. ..... 405/244; 52/157; 405/259.1

[58] Field of Search ..... 405/244, 259.1, 405/258; 52/157, 155, 158–162

[56] References Cited

U.S. PATENT DOCUMENTS

| | | | |
|---|---|---|---|
| 4,334,392 | 6/1982 | Dziedzic | 52/157 |
| 4,467,575 | 8/1984 | Dziedzic | 52/157 |
| 4,979,341 | 12/1990 | Norman et al. | 405/244 X |
| 4,981,000 | 1/1991 | Hamilton et al. | 52/157 |
| 5,286,142 | 2/1994 | Hoyt et al. | 405/244 |

*Primary Examiner*—Dennis L. Taylor
*Attorney, Agent, or Firm*—Jerry M. Presson; John A. Weresh; Edward A. McConwell, Jr.

[57] ABSTRACT

A clamshell screw anchor is provided which is inexpensive to manufacture, installable in many types of soils including rocky and frozen soils, and is adaptable for use in various applications, such as supporting electric transmission poles. The screw anchor broadly includes a unitary body member, a core, and a helical load bearing element. The body member is stamped from a substantially flat piece of material, and presents a pair of opposed, elongated body segments depending from a line of symmetry. Each of the body segments includes a first end shaped to define a hub element having a C-shaped cross section, a second end shaped to define a lead point element, and a pair of longitudinally extending side edges. The body member is folded about the line of symmetry, and the body segments are secured together along the side edges so that the hub elements form a hub having an open, upper end, and a rectangular cross-sectional shape, and the lead point elements form a lead point having an earth-engaging tip. The core is positioned within the shell, and includes a first end adjacent to the first ends of the body segments, and an axially extending tapped bore formed in the first end. The core is attachable to elongated support rods used to support poles, towers, and the like. The helical load bearing element presents a leading edge, and a trailing edge adjacent to the open, upper end of the hub. The load bearing element facilitates installation of the anchor into the earth, and resists pulling and tensional forces exerted on the anchor once it is positioned.

16 Claims, 2 Drawing Sheets

CLAMSHELL POWER INSTALLED SCREW ANCHOR

BACKGROUND OF THE INVENTION

1. Field of the Invention

The present invention relates generally to a screw anchor which may be installed in the earth by means of a rotational driving force for use in supporting loads. More particularly, the invention hereof concerns a clamshell screw anchor having a combined hub and earth-engaging lead point formed from a substantially flat piece of material folded about a line of symmetry. In another embodiment, a pair of substantially identical, flat pieces of material are formed and coupled to present a combined hub and earth-engaging lead point.

2. Description of the Prior Art

Presently, in the field of screw anchors, it is known to provide a screw anchor device including an anchor member coupled with an elongated rod component. For example, U.S. Pat. No. 4,334,392, issued to Dziedzic, discloses a screw anchor including an anchor member, and an earth-engaging lead point. The anchor member includes a hollow, round-cornered square hub, and a helical load bearing element that is secured around the hub. The earth-engaging lead point is either formed integrally, or threadably coupled, with a rod component and is received through and operably coupled with the hub so that when the assembly is installed in the ground, tension forces may be effectively resisted by the helical load-bearing element.

In operation, the hub and lead point are engaged by a wrench of a source of rotational driving force, and the anchor is rotatably driven into the earth. Once driven into the earth, the rod is attached to a guy wire. The guy wire, in turn, is used to support devices, such as electric transmission poles, or other similar structures. The rod and lead point component, however, are not securely attached to the anchor. As a result, the screw anchor disclosed in the '392 patent is relatively difficult to handle.

U.S. Pat. No. 4,467,575, issued to Dziedzic, discloses another screw anchor device based on the device disclosed in the '392 patent. The anchor disclosed in the '575 patent includes improvements in the design and construction of the anchor member. For example, a twist-lock feature is provided to couple the rod and lead point to the anchor so that the resulting assembly can be handled as one piece. This device also includes an improved earth-penetrating lead point, facilitating installation in rocky and frozen earth.

These prior art devices, however, are relatively expensive to manufacture. For example, these devices require lead point elements which are either cast or hot-forged into shape. Such operations are labor intensive and time consuming, making them relatively expensive and subject to production delays.

A unitary cast screw anchor is disclosed in U.S. Pat. No. 4,981,000, issued to Hamilton et al. This device is relatively strong so that it may be driven into rocky and frozen soils. The unitary cast construction, however, renders it relatively expensive, and subject to production delays. Therefore, a significant and heretofore unsolved need exists to provide a screw anchor which is relatively inexpensive and easy to manufacture.

SUMMARY OF THE INVENTION

It is an object of the present invention to provide a screw anchor which is able to support guy wires, and which is less expensive to manufacture than prior art devices having comparable load bearing capacity.

It is another object of the present invention to provide a screw anchor having a relatively simple design compared with prior art devices.

It is a further object of the present invention to provide a screw anchor having an anchor shell formed from a single piece of substantially flat material folded about a line of symmetry, and shaped to present a hub and an earth-engaging lead point.

A clamshell screw anchor constructed in accordance with the present invention broadly includes a pair of elongated body segments, a core positioned between the body segments, and a helical load bearing element secured to the body segments. The body segments each include a first end defining a hub element, a second end defining a lead point element, and a pair of longitudinally extending side edges. The body segments are secured together along the side edges to form an anchor shell having a hub defined by the hub elements, and a lead point defined by the lead point elements.

The hub presents an open, upper end and defines a polygonal cross-sectional shape. The hub is configured for receiving an anchor driving wrench. The lead point tapers toward an earth-engaging tip. With the helical load bearing element secured around the body segments, the wrench is used to drive the anchor into the earth. The helical load bearing element not only facilitates installation of the anchor into the earth, but, once positioned, resists tension and pulling forces exerted on the anchor. Additionally, the load bearing element reinforces the hub against deformation in a direction outward from the hub. The core is configured to be connected with an elongated rod, such as a guy rod. The guy rod, in turn, is then used to support such devices as telephone poles, transmission towers, and the like.

In a first construction of the preferred embodiment, the body segments are defined by a unitary body member and are opposed from one another, extending from a line of symmetry between the lead point elements. The body member is folded along the line of symmetry and the edges of the segments are secured together to form the anchor shell. By providing such an anchor, the lead point functions have been separated from the rod coupling functions, allowing more efficient production methods. The lead point functions are now performed by the stamped metal shells, while the rod coupling functions now reside in the core which is made by simply drilling, tapping, and cutting off a round bar. This relatively simple design also yields an anchor of relatively high strength so that it may be driven into rocky and frozen soils.

In another construction of the preferred embodiment, an anchor includes a pair of separate elongated body segments secured together to form an anchor shell. These segments may also be stamped and formed from substantially flat pieces of material. The body segments of this alternative anchor form an anchor shell having substantially the same dimensions as the shell described above. As a result, the helical load bearing element and core of the previously described anchor may be used.

DESCRIPTION OF THE DRAWING FIGURES

DETAILED DESCRIPTION OF THE PREFERRED EMBODIMENT

Figure 4:
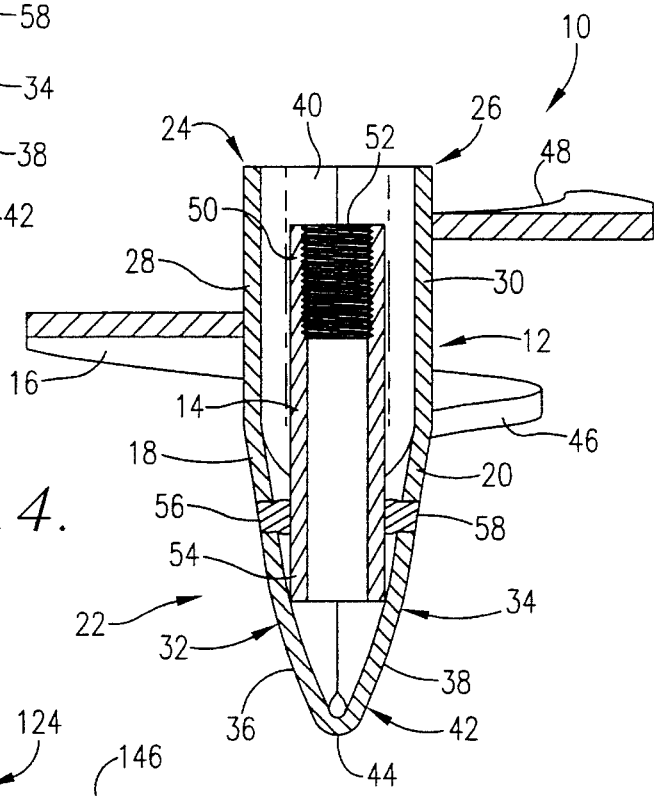
FIG. 4 is a cross-section view taken along line 4—4 if FIG. 2.

Referring now to FIG. 4, preferred screw anchor 10 constructed in accordance with the present invention broadly includes unitary body member 12, core 14 and helical load bearing element 16. Body member 12 presents a pair of opposed, elongated body segments 18 and 20, and is folded about a line of symmetry to form anchor shell 22.

Body segments 18 and 20 include first ends 24 and 26 defining C-shaped hub elements 28 and 30, and second ends 32 and 34 defining lead point elements 36 and 38. Each of body segments 18 and 20 also includes a pair of longitudinally extending side edges. Body segments 18 and 20 are secured together along the respective side edges so that hub elements 28 and 30 form hub 40, and lead point elements 36 and 38 form lead point 42.

Figure 2:
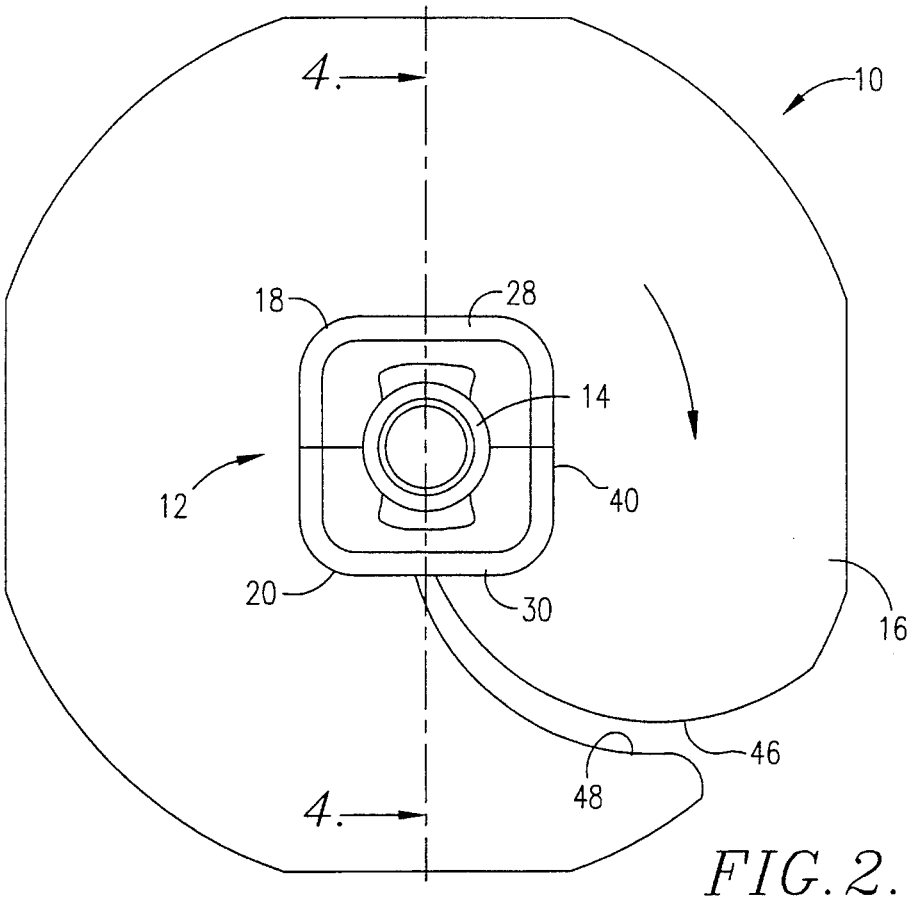
FIG. 2 is a plan view of the screw anchor of FIG. 1.
Figure 1:
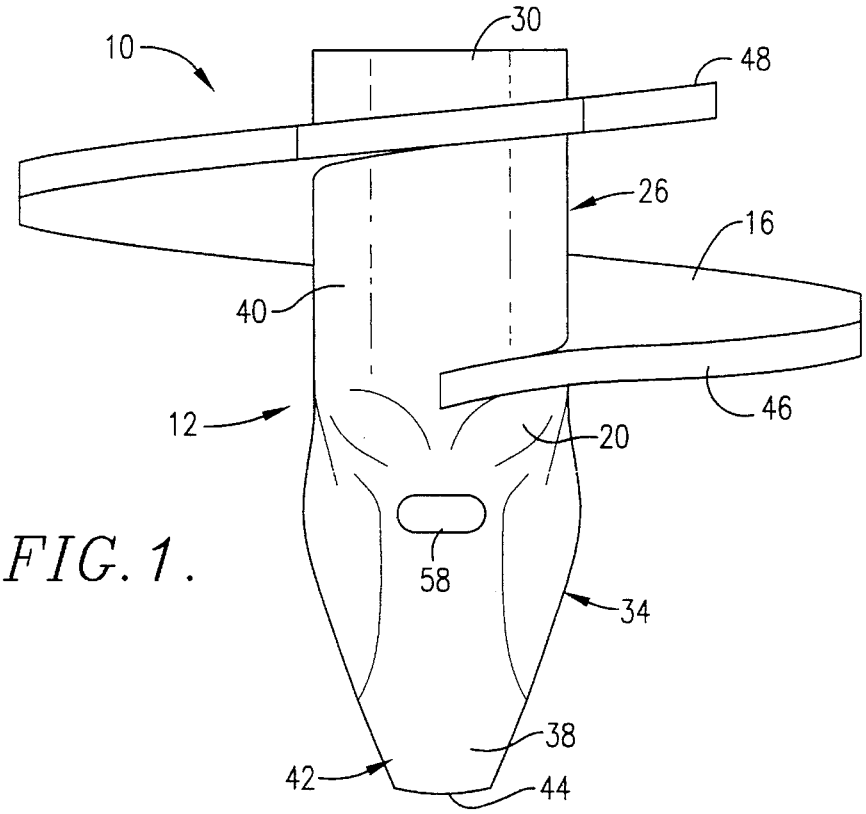
FIG. 1 is a side elevational view of a preferred embodiment of a screw anchor constructed in accordance with the present invention.
Figure 3:
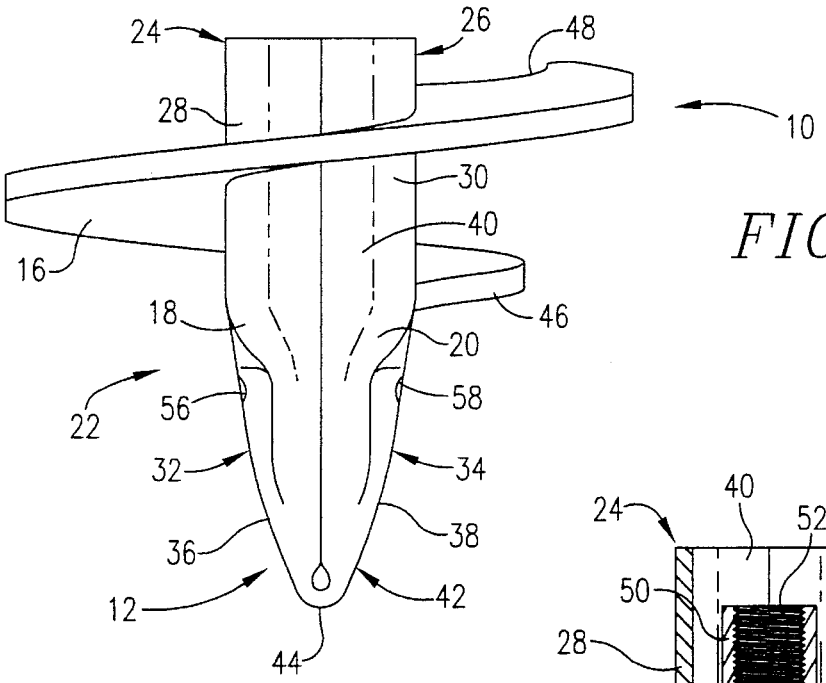
FIG. 3 is an end view of the screw anchor of FIG. 1.

As best seen in FIG. 2, hub 40 presents a hollow, rectangular cross-sectional shape, and is configured for receiving an anchor driving wrench of a source of rotational driving force. As shown in FIGS. 1 and 3, lead point 42 tapers towards tip 44 located adjacent the line of symmetry, and is configured for engaging the earth as anchor 10 is rotatably driven.

Helical load bearing element 16 presents leading edge 46 adjacent lead point 42 and trailing edge 48 adjacent upper ends 24 and 26, shown in FIG. 2. Load bearing element 16 is configured to assist in driving the screw anchor into the earth and, once the anchor is positioned, to hold the anchor in place by resisting tension or pulling forces.

Body member 12 and helical load bearing element 16 are each stamped from unitary, substantially flat pieces of metal. Body member 12 is then shaped so that hub elements 28 and 30 present a C-shaped cross-sectional shape, and form hub 40 having an open, upper end, and a substantially rectangular cross-sectional shape when body member 12 is folded and segments 18 and 20 are secured together. Load bearing element 16 is shaped to present a helical configuration.

Segments 18 and 20 may be secured together by spot welding them at selected positions along their respective side edges. Alternatively, the weld securing segments 18 and 20 may be continuous along their side edges.

Load bearing element 16 is welded around anchor shell 22 adjacent to hub 40. It will be appreciated that such a configuration further increases the structural integrity of anchor 10 by effectively wrapping body segments 18 and 20 together. Additionally, body member 12 and load bearing element 16 are stamped from material having substantially the same thickness. As a result, it is relatively easy to weld element 16 to shell 22.

Referring again to FIG. 4, core 14 includes first end 50 adjacent segment first ends 24 and 26, and axially extending, tapped bore 52 formed in first end 50. Bore 52 is configured to threadably receive a guy rod, or other elongated support rod.

Core 14 also includes second end 54 which is positioned adjacent openings 56 and 58 in segments 18 and 20. A weld is applied through openings 56 and 58 to secure core 14 within anchor shell 22. By so securing core 14, it is able to effectively withstand the pulling or tensional forces exerted by support rods.

In operation, the screw anchor is driven into the earth by a source of rotational driving force. A wrench extending from the source is inserted into hub 40. The wrench presents external dimensions which are substantially the same as the internal dimensions of hub 40, and internal dimensions which are larger than the external diameter of core 14. The industrial strength sources used to drive screw anchors into the earth for supporting guy wires of electric transmission poles are relatively large, and usually include a wrench having a square cross-sectional shape. Anchor 10 is configured for such applications.

The crossesection of hub 40 may, however, present alternative polygonal shapes. For example, hand driven screw anchors often use a wrench having more than four contact surfaces, such as hexagonal and octagonal configurations. These hand driven anchors are commonly smaller than anchor 10, and are used to support tents, and similar portable structures.

As best shown in FIG. 1, lead point 42 includes a bulged mid-section which has a width substantially the same as the diagonal length of the cross-section of hub 40. As a result, the hole created by lead point 42 as it is driven into the earth has substantially the same diameter as the diameter of hub 40 as it rotates, facilitating insertion of anchor 10 into the earth.

It will be appreciated that as anchor 10 is driven into the earth, leading edge 46 of helical load bearing element 16 cuts into the earth so that element 16 screws anchor 10 further into the earth. Once anchor 10 is driven to the desired depth within the earth, load bearing element 16 prevents anchor 10 from moving towards the surface when under tension or pulling forces.

An elongated rod is connected with core 14. Since core 14 is fixedly secured within shell 22, the elongated rod may be used to support guy wires. For example, a guy wire supporting an electric transmission pole may be connected to the rod. Load bearing element 16 prevents the anchor from moving toward the surface, thus anchoring the pole. An electric transmission tower, such as a radio or television tower, may also be supported by a guy wire connected with anchor 10.

Although the invention has been described with reference to illustrated anchor 10, it is noted that variations and changes may be made, and equivalents employed without departing from the scope of the invention as set forth in the claims. For example, core 14 is provided so that an elongated rod having an externally threaded end may be attached to bore 52, and thus anchor 10. Various other devices could also be used to allow attachment of an elongated rod. The rod could alternatively include an internally threaded end, requiring use of a core having an externally threaded first end. A rod could also be secured directly to shell 22 in lieu of core 14 and a detachable rod.

Figure 5:
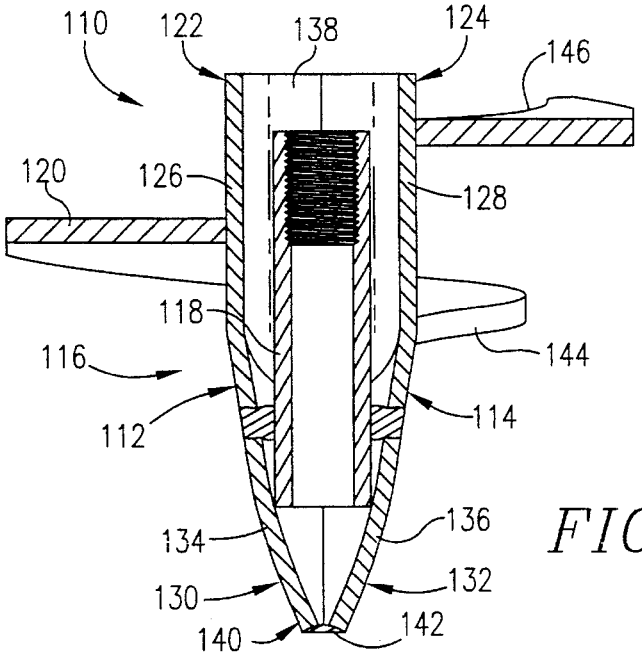
FIG. 5 is a cross-section view similar to FIG. 4 but of an alternative construction of the preferred embodiment.

Referring now to FIG. 5, anchor 110 constructed in accordance with an alternative construction of the preferred embodiment of the present invention broadly includes a pair of separate, elongated body segments 112 and 114 secured together to form anchor shell 116, core 118 positioned within shell 116, and helical load bearing element 120 secured around body segments 112 and 114. First ends 122 and 124 of body segments 112 and 114 define C-shaped hub elements 126 and 128. Second ends 130 and 132 of segments 112 and 114 define lead point elements 134 and 136. Body segments 112 and 114 also include longitudinally extending side edges.

Body segments 112 and 114 are coupled together along their respective side edges to form anchor shell 116 including hub 138, and lead point 140 tapering towards tip 142. It will be appreciated that anchor shell 116 is configured substantially the same and has substantially the same dimensions as anchor shell 22 of anchor 10. Therefore, hub 138 presents an open, upper end, and a hollow, rectangular cross-sectional shape (not shown), and is configured for receiving an anchor driving wrench of a source of rotational driving force.

Helical load bearing element 120 has substantially the same dimensions as load bearing element 18, and presents leading edge 144, and trailing edge 146 adjacent to first ends 122 and 124. Load bearing element 118 is configured to assist in driving anchor 110 into the earth, and once positioned, to hold anchor 110 in place by resisting tension and pulling forces.

Core 118 is substantially the same as core 14 of anchor 10, and is secured in substantially the same manner. As a result, core 118 is used to connect anchor 110 with an elongated support rod, such a guy rod.

It will be appreciated that body segments 112 and 114 are stamped from substantially flat pieces of metal, as is body member 12 of anchor 10, and shaped so that when segments 112 and 114 are secured together, they form anchor shell 116 presenting hub 138 and lead point 140. Hub 138 and lead point 140 are substantially similar to hub 40 and lead point 38 of anchor 10. This configuration, therefore, also gains the benefits of reduced manufacturing costs and product availability associated with anchor 10.

Load bearing element 120 is preferably stamped from a substantially flat piece of metal, and formed to define a helical shape. Element 120 is welded to and around anchor shell 116 adjacent to hub 138. It will be appreciated that such a configuration further increases the strength of the screw anchor by effectively wrapping body segments 112 and 114 together.

Segments 112 and 114 are secured together by applying a weld along their side edges and tip 144. Alternatively, segments 112 and 114 may be secured together by spot welding them at selected positions along their respective side edges and at tip 144.

What is claimed is:

1. A screw anchor comprising:

an anchor shell having a hub presenting an open, upper end and a hollow, polygonal cross-sectional shape, and a lead point, the shell being formed from relatively flat material, the material including a pair of elongated body segments, each segment including first and second ends and a pair of longitudinally extending side edges, the first ends being shaped to define hub elements presenting generally C-shaped cross-sections, the second ends being shaped to define lead point elements;

means for securing the body segments together along the side edges to present the anchor shell;

a core formed from an elongated bar and having a first end with a threaded bore formed therein;

means for securing the core to the anchor shell; and a helical load bearing element formed from relatively flat material, the load bearing element being secured to the body segments and presenting a leading edge and a trailing edge.

2. The screw anchor as set forth in claim 1, wherein the hub presents a rectangular cross-sectional shape and is configured for receiving an anchor driving wrench.

3. The screw anchor as set forth in claim 1, wherein the body segments are defined by a unitary body member presenting a line of symmetry, the body segments being opposed and extending from the line of symmetry.

4. The screw anchor as set forth in claim 3, wherein the means for securing the body segments together includes a weld adjacent to the side edges.

5. The screw anchor as set forth in claim 1, wherein the means for securing the body segments together includes a weld adjacent to the lead point elements.

6. The screw anchor as set forth in claim 1, the means for securing the body segments further including placement of the load bearing element around the body segments.

7. The screw anchor as set forth in claim 6, wherein the load bearing element is welded to the body segments adjacent the hub.

8. The screw anchor as set forth in claim 1, wherein the load bearing element presents a leading edge adjacent a lower end of the hub, and a trailing edge adjacent the upper end of the hub.

9. The screw anchor as set forth in claim 1, wherein the material forming each of the body segments and helical element includes substantially uniform thicknesses.

10. The screw anchor as set forth in claim 9, wherein the thicknesses of the body segments and the helical element are approximately the same.

11. The screw anchor as set forth in claim 1, wherein the core includes a first end adjacent the upper end of the hub, and an axially extending tapped bore formed in the first end.

12. The screw anchor as set forth in claim 11, wherein at least one body segment includes an opening therethrough adjacent the lead point, the core presents a second end, and the core second end is adjacent the opening.

13. The screw anchor as set forth in claim 11, wherein each of the body segments includes an opening therethrough adjacent its respective lead point element, the core presents a second end, and the core second end is adjacent the corresponding openings.

14. The screw anchor as set forth in claim 1, wherein the lead point is generally hollow.

15. A screw anchor comprising:

a unitary anchor shell having a hub presenting an open, upper end and a hollow, polygonal cross-sectional shape, and a lead point, the shell including a unitary body member formed from substantially flat material, the body member presenting a pair of elongated body segments, each segment including first and second ends and a pair of side edges extending between the first and second ends, each of the first ends being shaped to define a hub element having a generally C-shaped cross section, each of the second ends being shaped to define a lead point element;

means for securing the body segments of the body member together adjacent to the second ends and along the side edges to form the anchor shell;

a core positioned within the hub;

means for securing the core to the body segments; and a helical load bearing element formed from relatively flat material, the load bearing element being secured to the body segments and presenting a leading edge and a trailing edge.

16. The screw anchor as set forth in claim 15, wherein the lead point is generally hollow.

* * * * *